US010757992B2

(12) United States Patent
Studinger

(10) Patent No.: US 10,757,992 B2
(45) Date of Patent: Sep. 1, 2020

(54) JACKET POCKET ARRANGEMENT

(71) Applicant: James Paul Studinger, Bloomfield Hills, MI (US)

(72) Inventor: James Paul Studinger, Bloomfield Hills, MI (US)

( * ) Notice: Subject to any disclaimer, the term of this patent is extended or adjusted under 35 U.S.C. 154(b) by 283 days.

(21) Appl. No.: 15/724,408

(22) Filed: Oct. 4, 2017

(65) Prior Publication Data

US 2019/0098948 A1 Apr. 4, 2019

(51) Int. Cl.

| | |
|---|---|
| ***A41D 27/00*** | (2006.01) |
| ***A41D 27/20*** | (2006.01) |
| ***A41D 1/02*** | (2006.01) |
| *A41D 13/08* | (2006.01) |
| *A41D 3/00* | (2006.01) |

(52) U.S. Cl.

CPC ..... *A41D 27/201* (2013.01); *A41D 1/02* (2013.01); *A41D 3/00* (2013.01); *A41D 13/081* (2013.01); *A41D 2400/10* (2013.01)

(58) Field of Classification Search

CPC ..... A41D 27/201; A41D 27/02; A41D 3/00; A41D 13/081

See application file for complete search history.

(56) References Cited

U.S. PATENT DOCUMENTS 3,077,604 A * 2/1963 Colangelo ..... A41D 27/20 2/93
4,651,348 A * 3/1987 Swanson ..... A41D 27/20 2/253
4,773,102 A * 9/1988 Curtis ..... A41D 1/04 2/102
4,882,786 A * 11/1989 Gross ..... A41D 13/0012 2/94
6,119,269 A * 9/2000 Imler ..... A41D 13/0012 2/102
7,467,423 B1 * 12/2008 Tawfik ..... A41D 23/00 2/207
8,234,720 B2 * 8/2012 Freedman ..... A41D 27/201 2/108
9,066,547 B2 * 6/2015 Kim ..... A41D 27/20
2002/0040493 A1 * 4/2002 Wooley ..... A41D 13/0012 2/102
2005/0102729 A1 * 5/2005 Snedeker ..... A41D 13/0002 2/96
2009/0265829 A1 * 10/2009 Gomes Seguin ..... A41D 3/04 2/87

* cited by examiner

*Primary Examiner* — Richale L Quinn

(74) *Attorney, Agent, or Firm* — Carlson, Gaskey & Olds, P.C.

(57) ABSTRACT

A jacket includes a body portion having an exterior surface and a first edge for mating with an opposing second edge. A first pocket opening extends through the exterior surface of the body portion. A first pocket member at least partially defines a first pocket cavity in communication with the first pocket opening and the first pocket member at least partially defines a pocket mating opening. A second pocket opening extends through the exterior surface of the body portion and a second pocket member at least partially defines a second pocket cavity in communication with the second pocket opening. The second pocket member at least partially defines a pocket mating insert that is moveable between a retracted position spaced inward from the first edge and an extended position extending outward from the second edge. The pocket mating insert is configured to be received by the pocket mating opening.

20 Claims, 4 Drawing Sheets

JACKET POCKET ARRANGEMENT

BACKGROUND

The present disclosure relates to an apparatus and method related to an improvement in cold weather apparel. In order to improve warmth and comfort, apparel has tended to become bulkier and less comfortable. Therefore, there is a need to improve warmth of apparel without adding bulk or weight.

SUMMARY

A jacket includes a body portion having an exterior surface and a first edge for mating with an opposing second edge. A first pocket opening extends through the exterior surface of the body portion. A first pocket member at least partially defines a first pocket cavity in communication with the first pocket opening and the first pocket member at least partially defines a pocket mating opening. A second pocket opening extends through the exterior surface of the body portion and a second pocket member at least partially defines a second pocket cavity in communication with the second pocket opening. The second pocket member at least partially defines a pocket mating insert that is moveable between a retracted position spaced inward from the first edge and an extended position extending outward from the second edge. The pocket mating insert is configured to be received by the pocket mating opening.

These and other features of the disclosed examples can be understood from the following description and the accompanying drawings, which can be briefly described as follows.

DETAILED DESCRIPTION

Figures 1, 2:
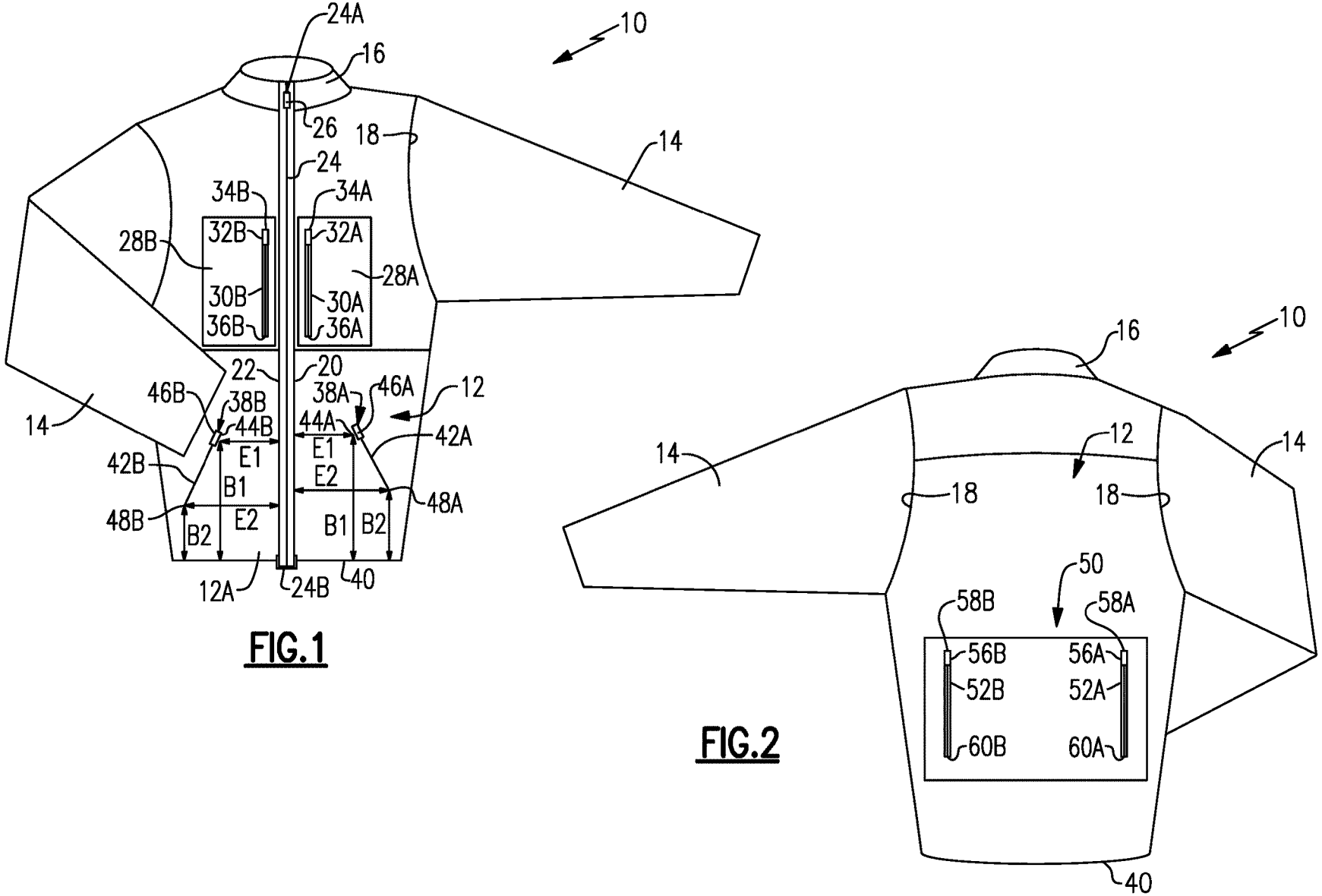
FIG. 1 is a front view of an example jacket.
FIG. 2 is a back view of the jacket of FIG. 1.

FIG. 1 illustrates a jacket 10 including a body portion 12, sleeves 14, and a collar 16. The sleeves 14 attach to the body portion 12 at arm openings 18 in the body portion 12. In another example, the jacket 10 does not include sleeves 14 and the body portion 12 is open at the arm openings 18.

The body portion 12 includes a first edge 20 for mating with a second edge 22 to enclose the body portion 12. In the illustrated example, the first edge 20 and the second edge 22 form a zipper 24 having teeth along the first edge 20 that mate with corresponding teeth along the second edge 22. The zipper 24 includes a slider 26 adjacent a top stop 24A when in a fully closed position. A detachable connection 24B, such as a box and pin connection, is located at an opposite end of the zipper 24 from the top stop 24A to allow the first and second edges 20, 22 of the body portion 12 to separate when the slider 26 is located at the detachable connection 24B. Alternatively, the first edge 20 and the second edge 22 are joined together with buttons or snaps extending along one of the first and second edges 20, 22 for mating with a corresponding receptacle located along the other of the first and second edges 20, 22.

The jacket 10 includes first and second chest pockets 28A, 28B adjacent the first edge 20 and the second edge 22, respectively. The first and second check pockets 28A, 28B include first and second zippers 30A, 30B with first and second sliders 32A, 32B located adjacent first and second top stops 34A, 34B when in a closed position and adjacent first and second bottom stops 36A, 36B when in a fully open position.

The jacket 10 also includes first and second hand pockets 38A, 38B on adjacent the first and second edges 20, 22, respectively, and a bottom edge 40 of the body portion 12. The first and second hand pockets 38A, 38B include a first and second zipper 42A, 42B with first and second sliders 44A, 44B located adjacent a top stop 46A, 46B when in a closed position and adjacent a bottom stop 48A, 48B, respectively when in a fully open position.

In the illustrated example, the top stops 46A, 46B are spaced a first distance B1 from the bottom edge 40 and the bottom stops 48A, 48B are located a second distance B2 from the bottom edge with the first distance being greater than the second distance. Furthermore, the first and second top stops 46A, 46B are located a first distance E1 from the first and second edges 20, 22 and the first and second bottom stops 48A, 48B are located a second distance E2 from the first and second edges 20, 22, respectively, and the second distance E2 is greater than the first distance E1. Therefore, a length of the zippers 42A, 42B are transverse to both the bottom edge 40 and the first and second edges 20, 22. Moreover, because the zippers 42A, 42B move downward toward the bottom edge 40, a size of the zipper openings can be reduced to reduce air leaking into the first and second hand pockets 38A, 38B.

As shown in FIG. 2, a rear of the jacket 10 includes a central back pocket 50 accessible through first and second rear zippers 52A, 52B. The first and second zippers 54A, 54B include first and second sliders 56A, 56B located adjacent first and second top stops 58A, 58B when in a closed position and adjacent first and second bottom stops 60A, 60B when in a fully open position.

Figure 3:
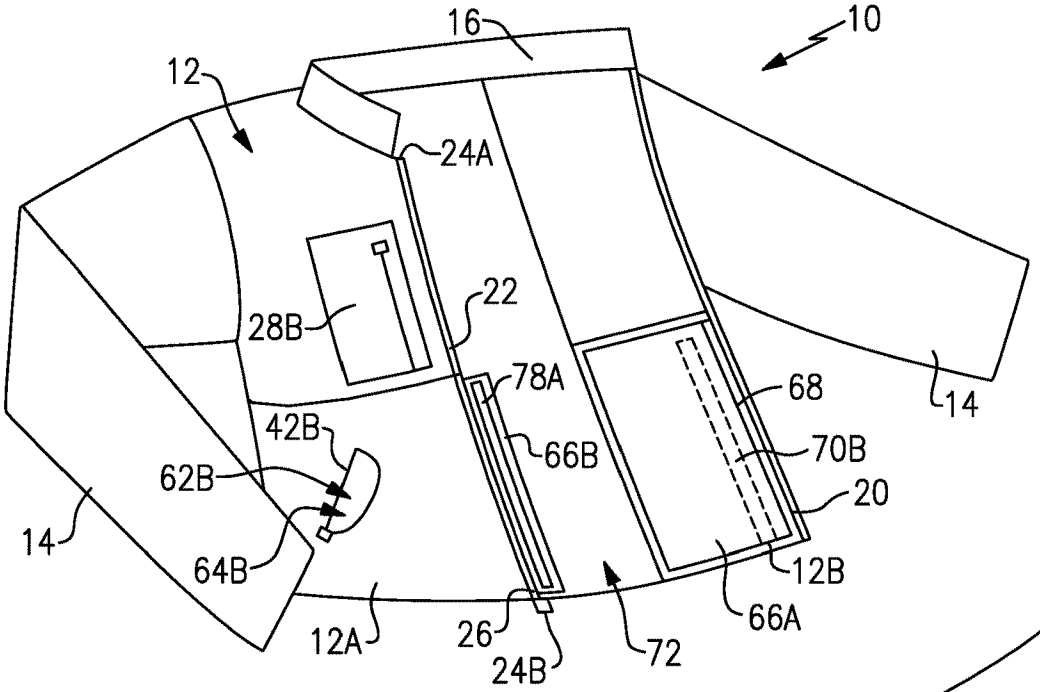
FIG. 3 is a partially open view of the jacket of FIG. 1.
Figure 4:
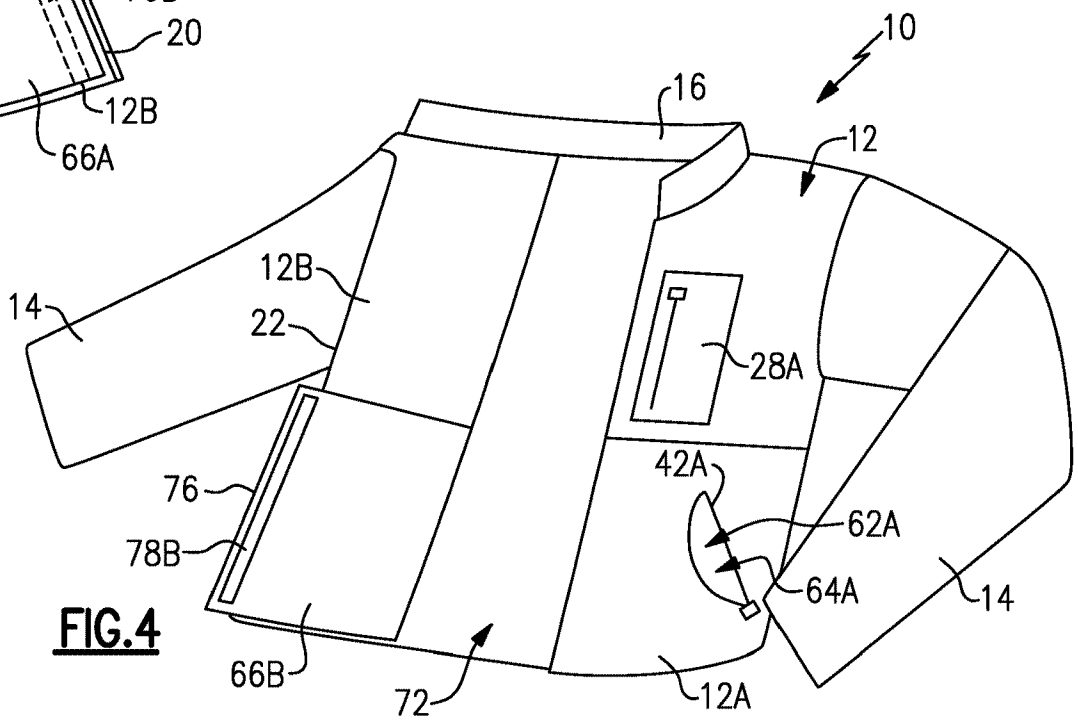
FIG. 4 is another partially open view of the jacket of FIG. 1.

As shown in FIGS. 1,3, and 4, the first and second zippers 42A, 42B define first and second pocket openings 62A, 62B extending through an exterior surface 12A of the body portion 12 into a first and second pocket cavities 64A, 64B, respectively. In the illustrated example, the first and second pocket cavities 64A, 64B are at least partially defined by the body portion 12 and a first and second pocket member 66A, 66B, respectively, attached to an inner surface 12B of the body portion 12. Alternatively, the first and second pocket cavities 64A, 64B are defined by the first and second pocket member 66A, 66B without the body portion 12.

Figure 5:
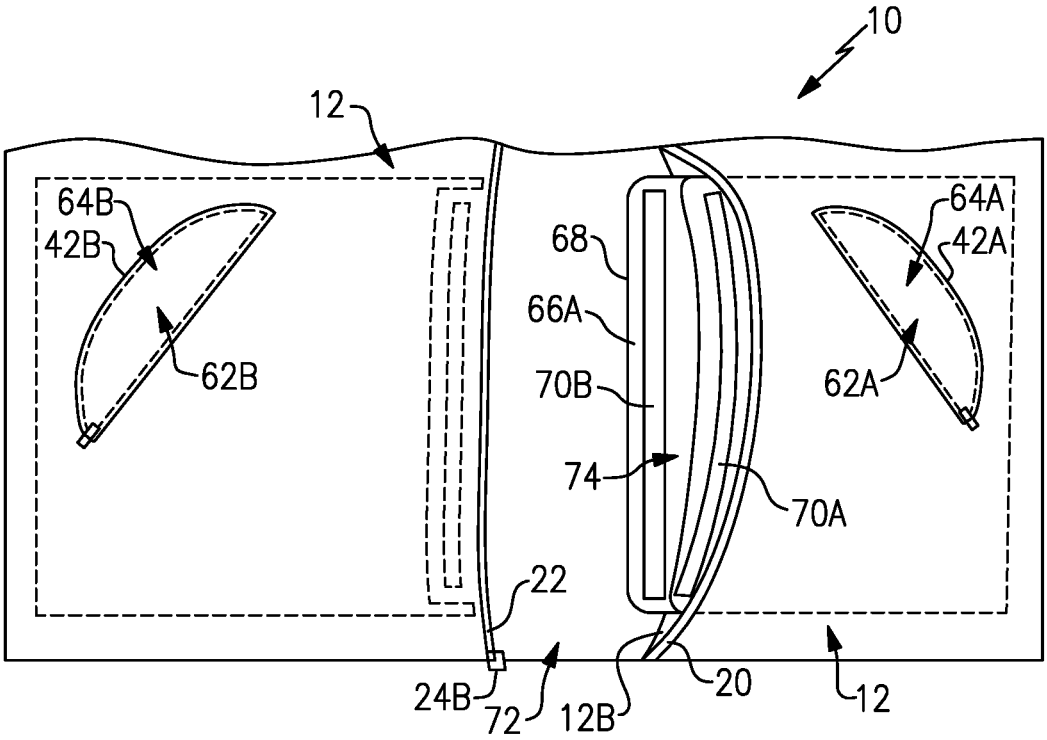
FIG. 5 illustrates a first pocket cavity.

As shown in FIGS. 3 and 5, an edge 68 of the first pocket member 66A is located adjacent the first edge 20 of the body portion 12. The first pocket cavity 64A is retained in a closed position by an outer sealing member 70A adjacent the interior surface 12B of the body portion 12 and an inner sealing member 70B adjacent an inner cavity 72 of the jacket 10. In the illustrated example, the outer sealing member 70A includes one of a hook or loop closure and the inner sealing member 70B includes the other of the hook or loop closure. The inner and outer sealing members 70A, 70B allow the first edge 68 of the first pocket cavity 64A to form a pocket mating opening 74 for joining the first and second pocket cavities as described below. Alternatively, a zipper or magnets could be used in place of the hook and loop closure of the inner and outer sealing members 70A, 70B.

Figure 6:
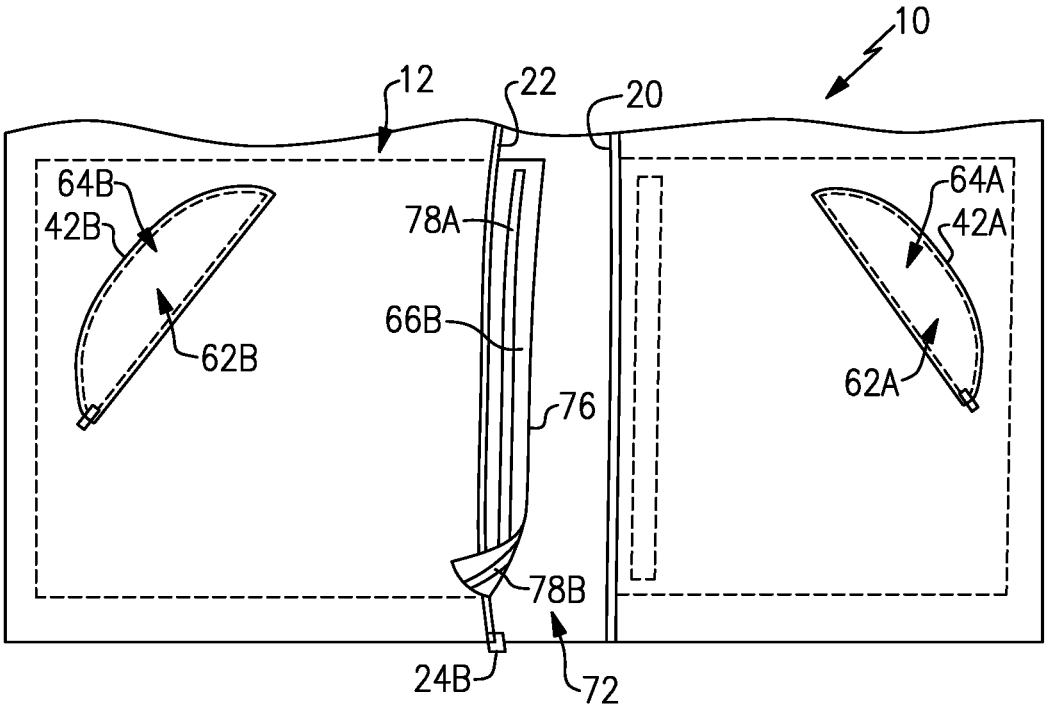
FIG. 6 illustrates a second pocket cavity.

As shown in FIGS. 4 and 6, an edge 76 of the second pocket member 66B is located adjacent the second edge 22 of the body portion 12. The second pocket cavity 64B is retained in a closed position by an outer sealing member 78A and an inner sealing member 78B when the edge 76 is retracted into the second pocket cavity 64B. The inner and outer sealing members 78A, 78B are located on an exterior surface of the second pocket member 66B and on an opposite side of the second pocket member 66B from the second pocket cavity 64B. The second pocket member 66B also extends past the second edge 22 of the body portion 12 when in an extended position as shown in FIG. 6 and can be retracted into the second pocket cavity 64B such that the second pocket member 66B does not extend beyond the second edge 22 of the body portion.

Figure 7:
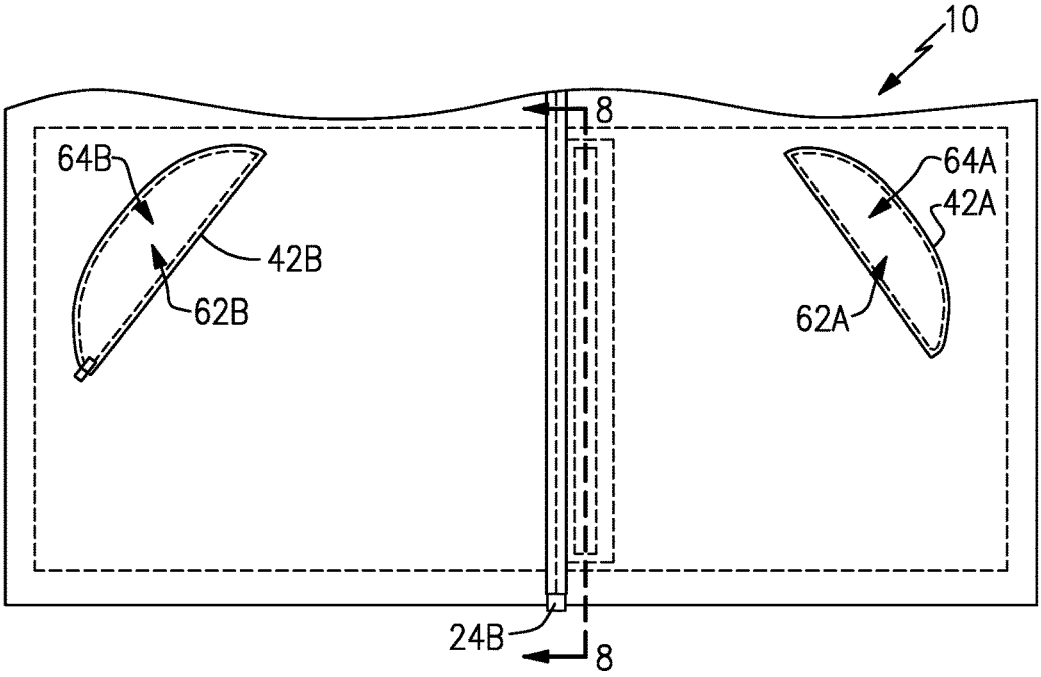
FIG. 7 illustrates the first pocket cavity jointed with the second pocket cavity.

In the illustrated example, the outer sealing member 78A includes one of a hook or loop closure and the inner sealing member 78B includes the other of the hook or loop closure. The inner and outer sealing members 78A, 78B allow the edge 76 of the second pocket cavity 64B to form a pocket mating insert 80 that is accepted within the pocket mating opening 74 as shown in FIG. 7. Alternatively, a zipper could be used in place of the hook and loop closure of the inner and outer sealing members 78A, 78B.

The first and second pocket cavities 64A, 64B can be joined by opening the pocket mating opening 74 with one hand and opening the second pocket member 66B and deploying the pocket mating insert 80 with another hand, such that the pocket mating insert 80 extends into the pocket mating opening 74. The hook and loop closure of the outer sealing members 70B, 78B corresponding with the hook and loop closure of the inner sealing members 70A, 70B to join the first and second pocket cavities 64A, 64B.

Figure 8:
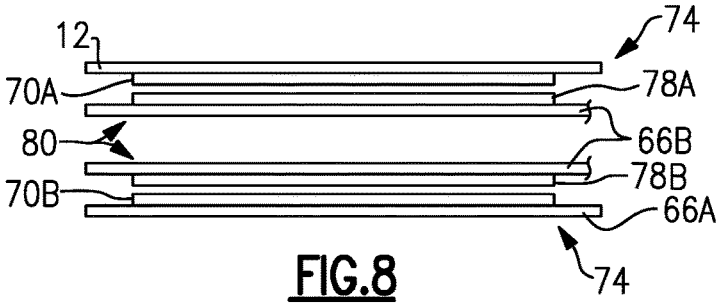
FIG. 8 is a cross-sectional view taken along line 8-8 of FIG. 7.

FIG. 8 is a cross-sectional view taken along line 8-8 of FIG. 7 illustrating the connection between the pocket mating insert 80 and the pocket mating opening 74. As shown in FIG. 8, the outer sealing member 70A on the body portion 12 is connected to the outer sealing member 78A on the second pocket member 66B. Alternatively, the outer sealing member 70A could be attached to the first pocket member 66A if the first pocket member 66A is used to define inner and outer sides of the first pocket cavity 64A. A spacing exists between the inner surfaces of the second pocket member 66B to allow the first pocket cavity 64A to be in communication with the second pocket cavity 64B. This connection between the first and second pocket cavities 64A, 64B allows a person to keep his or her hands warmer by allowing both hands to share the same insulated space by being able to quickly connect the first and second pocket cavities 64A, 64B. Also, the overlap between the pocket mating insert 80 and the pocket mating opening 74 reduces air leakage into the insulated space.

Figure 10:
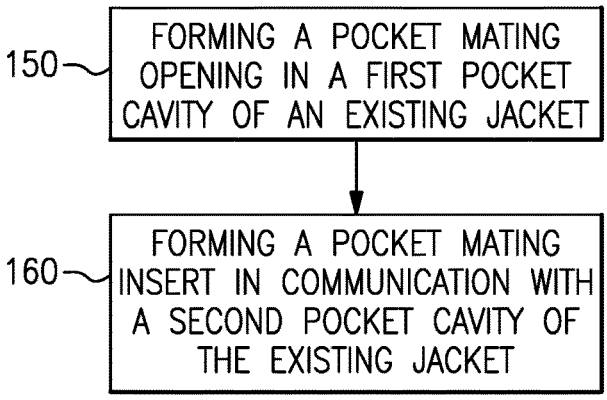
FIG. 10 illustrates the steps for incorporating the disclosure into an existing jacket.

The ability to have a shared space for both hands can also be incorporated into an existing jacket. The above described shared pockets can be created in existing jackets by forming a pocket mating opening as described above in a first pocket cavity of the existing jacket. (Step 150, FIG. 10).

Figure 9:
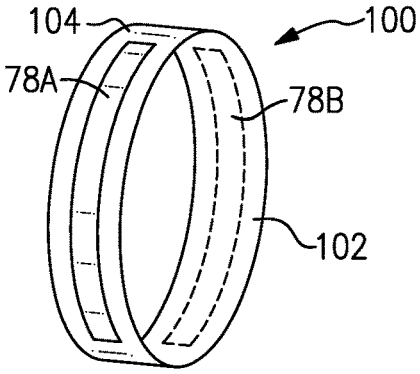
FIG. 9 is a ring for forming a pocket mating insert.

A pocket mating insert can be formed in communication with a second pocket cavity as described above. (Step 160, FIG. 10). When attaching the pocket mating insert to the second pocket cavity, the pocket mating insert can be formed in the shape of a ring 100 (FIG. 9) with an interior 102 of the ring 100 being in communication with the second pocket cavity. The inner and outer sealing members 78A, 78B are located on an exterior 104 of the ring 100. The ring 100 can be retracted into the second pocket cavity and sealed closed with the inner and outer sealing members 78A, 78B because the ring 100 is turned inside out when retracted such that the inner and outer sealing members 78A, 78B can engage each other. When in the extending position, the ring 100 can be used to joint first and second pocket cavities.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A jacket comprising:

a body portion having an exterior surface and a first edge for mating with an opposing second edge;

a first pocket opening extending through the exterior surface of the body portion;

at least one first pocket member defining a first pocket cavity with the first pocket opening extending into the first pocket cavity, wherein the at least one first pocket member at least partially defines a pocket mating opening with a first outer scaling member adjacent the body portion and a first inner sealing opposite the outer sealing member for selectively closing the pocket mating opening;

a second pocket opening extending through the exterior surface of the body portion; and at least one second pocket member defining a second pocket cavity with the second pocket opening extending into the second pocket cavity, wherein the at least one second pocket member at least partially defines a pocket mating insert that is moveable between a retracted position with a second inner sealing member engaging a second outer sealing member and an extended position with the second inner sealing member engaging the first inner sealing member and the second outer sealing member engaging the first outer sealing member.

2. The jacket of claim 1, wherein the first inner sealing member includes one of a first hook closure or a first loop closure extending around a majority of the pocket mating opening, the first outer sealing member includes the other of the first hook closure or the first loop closure extending around a majority of the pocket mating opening, the second inner sealing member includes one of a second hook closure or a second loop closure extending around a majority of the pocket mating insert, and the second outer sealing member includes the other of the second hook closure or the second loop closure extending around a majority of the pocket mating insert.

3. The jacket of claim 1, wherein the second pocket member is received within the first pocket member in an overlapping relationship.

4. The jacket of claim 3, wherein the first inner sealing member engages the second inner sealing member and the first outer sealing member engages the second outer sealing member when the pocket mating insert is received within the pocket mating opening.

5. The jacket of claim 1, wherein the first inner and outer sealing members and the second inner and outer sealing members include at least one zipper.

6. The jacket of claim 1, wherein the at least one first pocket member is non-extendable and is spaced inward from the first edge of the body portion.

7. The jacket of claim 1, wherein an interior surface of the first pocket cavity is at least partially defined by the at least one first pocket member and the body portion.

8. The jacket of claim 1, including a first zipper member located along the first edge of the body portion that mates with a second zipper member located along the second edge of the body portion.

9. The jacket of claim 1, including a plurality of buttons along one of the first edge and the second edge for mating with corresponding receptacles on the other of the first edge and the second edge.

10. The jacket of claim 1, wherein the body portion includes a base edge and the first pocket opening is transverse to the first edge and the base edge and the second pocket opening is transverse to the second edge and the base edge.

11. The jacket of claim 1, wherein the pocket mating opening includes the at least one first pocket member on a first side and the body portion on a second opposite side.

12. The jacket of claim 1, wherein the body portion includes sleeves and the first edge is attached to the second edge with a zipper.

13. The jacket of claim 1, wherein the at least one second pocket member includes a ring of material and the second inner sealing member and the second outer sealing member are located on a common side of the ring.

14. The jacket of claim 1, wherein the at least one second pocket member extends into the second pocket cavity in the retracted position and forms a flap.

15. The jacket of claim 1, wherein the second inner sealing member fixedly engages the second outer sealing member when the at least one second pocket member is in the retracted position.

16. The jacket of claim 15, wherein the second inner sealing member includes one of a hook or loop closure and the second outer sealing member includes the other of the hook and loop closure.

17. The jacket of claim 1, wherein the second inner sealing member and the second outer sealing member are aligned to form a ring around a majority of the at least one second pocket member.

18. A jacket comprising:

a body portion having an exterior surface and a first edge for mating with an opposing second edge;

a first pocket opening extending through the exterior surface of the body portion;

at least one first pocket member defining a first pocket cavity with the first pocket opening extending into the first pocket cavity, wherein the at least one first pocket member at least partially defines a pocket mating opening with a first outer sealing member adjacent the body portion and a first inner sealing opposite the outer sealing member for selectively closing the pocket mating opening;

a second pocket opening extending through the exterior surface of the body portion; and at least one second pocket member forming a ring and at least partially defining a second pocket cavity with the second pocket opening extending into the second pocket cavity, wherein the ring at least partially defines a pocket mating insert that is moveable between a retracted position with a second inner sealing member engaging a second outer sealing member and an extended position with the second inner sealing member engaging the first inner sealing member and the second outer sealing member engaging the first outer sealing member.

19. The jacket of claim 18, wherein a complete circumferential portion of the insert is received within the first pocket mating opening when in the extended position.

20. The jacket of claim 19, wherein the first inner sealing member includes one of a first hook closure or a first loop closure extending around a majority of the first pocket mating opening, the first outer sealing member includes the other of the first hook closure or the first loop closure extending around a majority of the first pocket mating opening, the second inner sealing member includes one of a second hook closure or a second loop closure extending around a majority of the pocket mating insert, and the second outer sealing member includes the other of the second hook closure or the second loop closure extending around a majority of the pocket mating insert.

* * * * *